US009785109B2

(12) United States Patent
Ohata

(10) Patent No.: US 9,785,109 B2
(45) Date of Patent: Oct. 10, 2017

(54) IMAGE FORMING APPARATUS

(71) Applicant: KYOCERA Document Solutions Inc., Osaka (JP)

(72) Inventor: Shinobu Ohata, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/237,032

(22) Filed: Aug. 15, 2016

(65) Prior Publication Data

US 2017/0060079 A1 Mar. 2, 2017

(30) Foreign Application Priority Data

Aug. 28, 2015 (JP) ..... 2015-169571

(51) Int. Cl.

| | |
|---|---|
| ***G03G 15/00*** | (2006.01) |
| ***G03G 21/16*** | (2006.01) |
| *G03G 15/08* | (2006.01) |
| *G03G 15/23* | (2006.01) |

(52) U.S. Cl.

CPC ..... *G03G 21/1647* (2013.01); *G03G 21/1652* (2013.01); *G03G 15/0879* (2013.01); *G03G 15/234* (2013.01); *G03G 2215/0132* (2013.01)

(58) Field of Classification Search

CPC ..... G03G 21/1647; G03G 21/1652; G03G 15/0879; G03G 15/234; G03G 2215/0132

USPC ..... 399/121, 124

See application file for complete search history.

(56) References Cited

U.S. PATENT DOCUMENTS

| | | | | |
|---|---|---|---|---|
| 2013/0188982 | A1* | 7/2013 | Souda | G03G 21/1652 399/90 |
| 2015/0268622 | A1* | 9/2015 | Maeda | G03G 15/1605 399/121 |
| 2016/0062313 | A1* | 3/2016 | Matsumoto | G03G 21/1867 399/121 |

FOREIGN PATENT DOCUMENTS

JP 2010-049095 A 3/2010

* cited by examiner

*Primary Examiner* — Susan Lee

(74) *Attorney, Agent, or Firm* — Studebaker & Brackett PC

(57) ABSTRACT

An image forming apparatus includes a fixed contact point and a movable contact point. The fixed contact point is provided in a unit side opposing part. A movable contact point is provided in a rail side opposing part. The rail side opposing part is formed with an opening. The movable contact point is a contact spring formed of an electrical conductive wire. The movable contact point has a fixing part, a contact part and a pull-out prevention part. The fixing part is fixed to the rail on an opposite side to the rail side opposing part. The contact part is biased with respect to the fixing part to protrude toward the fixed contact point through the opening. The pull-out prevention part restricts a protruding position of the contact part toward the fixed contact point. The pull-out prevention part is formed into a spiral shape.

8 Claims, 8 Drawing Sheets

IMAGE FORMING APPARATUS

INCORPORATION BY REFERENCE

This application is based on and claims the benefit of priority from Japanese Patent application No. 2015-169571 filed on Aug. 28, 2015, the entire contents of which are incorporated herein by reference.

BACKGROUND

The present disclosure relates to an image forming apparatus including an attachable/detachable intermediate transferring unit.

A full color image forming apparatus of recent years generally has a tandem-type configuration. In the tandem-type configuration, an image forming part provided for each toner color is disposed along a traveling direction of an endless intermediate transferring belt. In each image forming part, a single-color toner image is sequentially first-transferred onto the intermediate transferring belt to form a full-color toner image, and the full-color toner image is second-transferred onto a sheet. When the single-color toner image is transferred from each image forming part onto the intermediate transferring belt, a high voltage transferring bias is applied from a transferring bias power source to a first transferring roller which is disposed inside of a hollow space of the intermediate transferring belt so as to oppose to each image forming part.

The intermediate transferring belt and the first transferring rollers are united into an intermediate transferring unit. For the purpose of replacement or maintenance of the intermediate transferring belt or the first transferring roller, the intermediate transferring unit is configured to slide along a rail provided in an apparatus main body so as to be attachable to or detachable from the apparatus main body. The intermediate transferring unit is provided with a fixed contact point electrically connecting to the first transferring roller. On the other hand, the rail is provided with a movable contact point electrically connecting to the transferring bias power source. When the intermediate transferring unit is slid along the rail to be attached to the apparatus main body, the fixed contact point and the movable contact point are electrically connected to each other and a transferring bias is applied from the transferring bias power source to the first transferring roller.

In a case where the fixed contact point is provided in the intermediate transferring unit and the movable contact point is provided in the rail as described above, when the intermediate transferring unit is slid along the rail, there may be a case in which the movable contact point is hooked by the intermediate transferring unit or a frictional force between the movable contact point and the fixed contact point is too strong. In such a case, the movable contact point may be spaced away from the rail or the position of the movable contact point may be changed and then a contact failure between the movable contact point and the fixed contact point may occur.

In addition, there may be a case in which a plate-shaped movable contact point is provided in the intermediate transferring unit and the fixed contact point is provided in the rail. The movable contact point and the fixed contact point are disposed to oppose to each other in a vertical direction. One end portion of the movable contact point is fixed to the intermediate transferring unit and the other end portion is folded to form an engaging claw. Then, by engaging the engaging claw with an anti-folding member formed in the rail, the buckling of the engaging claw is prevented.

SUMMARY

In accordance with an embodiment of the present disclosure, an image forming apparatus includes a unit, a unit side opposing part, a rail side opposing part, a fixed contact point and a movable contact point. The unit is supported to be slidable along a rail between a position to be housed in an apparatus main body and a position to be pulled out from the apparatus main body. The unit side opposing part and a rail side opposing part are respectively provided on the unit and the rail so as to oppose to each other when the unit is slid along the rail into the position to be housed in the apparatus main body. The fixed contact point is provided in the unit side opposing part of the unit. The movable contact point is provided in the rail side opposing part of the rail and brings into pressure contact with the fixed contact point so as to be electrically connected to the fixed contact point. The rail side opposing part of the rail is formed with an opening. The movable contact point is a contact spring formed of an electrical conductive wire. The movable contact point has a fixing part, a contact part and a pull-out prevention part. The fixing part is fixed to the rail on an opposite side to the rail side opposing part. The contact part is biased with respect to the fixing part to protrude toward the fixed contact point through the opening. The pull-out prevention part is configured to restrict a protruding position of the contact part toward the fixed contact point. The pull-out prevention part is formed into a spiral shape.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

Hereinafter, with reference to figures, an image forming apparatus according to an embodiment of the present disclosure will be described.

Figure 1:
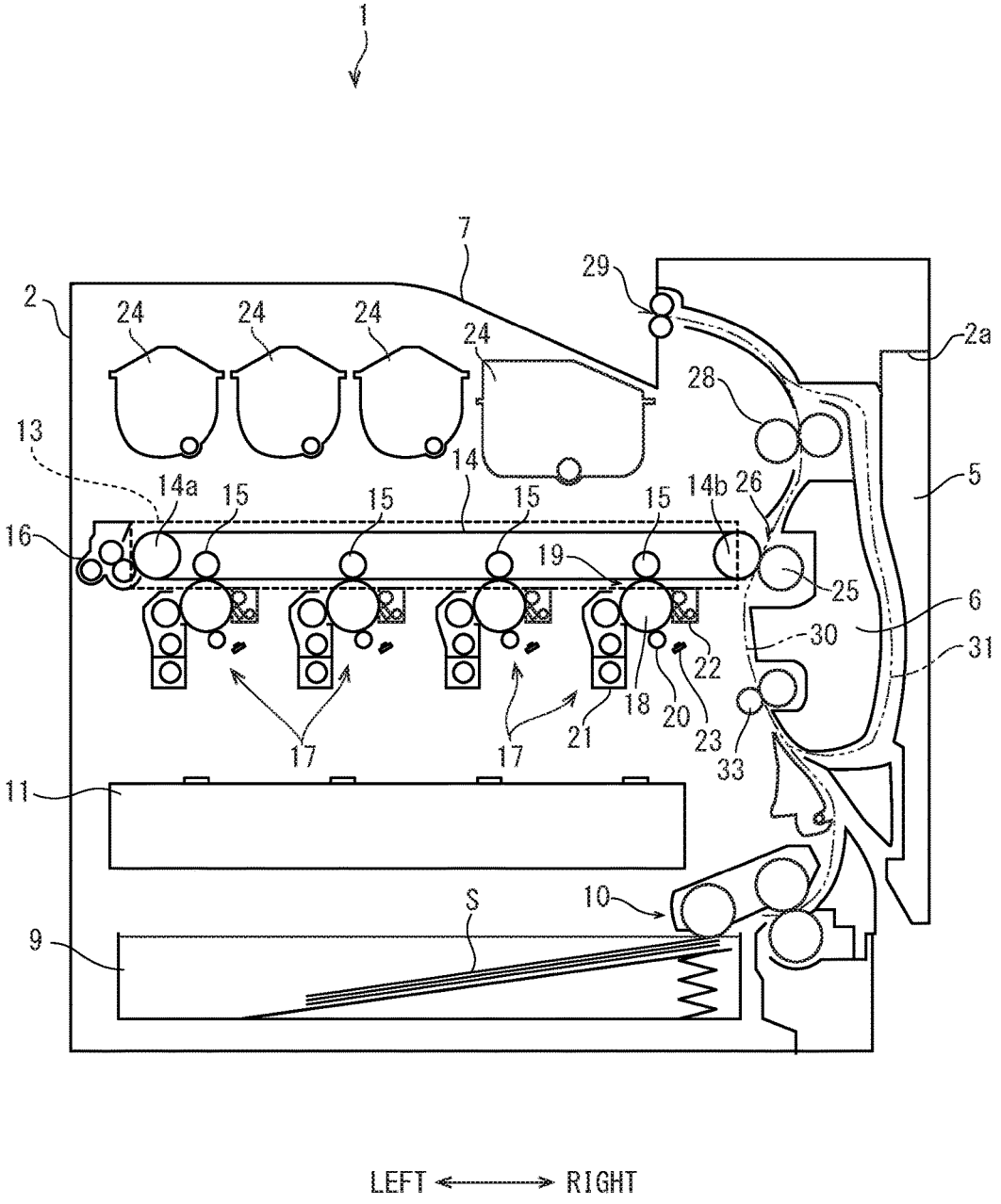
FIG. 1 is a view schematically showing an internal structure of a color printer according to an embodiment of the present disclosure.

First, with reference to FIG. 1, an entire structure of a color printer 1 as an image forming apparatus will be described. FIG. 1 is a perspective view schematically showing the color printer 1. In the following description, a front side of FIG. 1 shows a front side of the color printer, and left and right directions are based on a direction viewed the color printer 1 from the front side.

The color printer 1 is provided with an apparatus main body 2 of a rectangular parallelepiped shape as shown in FIG. 1. On a right side face of the apparatus main body 2, an opening 2*a* is formed. The opening 2*a* is opened and closed by a both-face conveying unit 5 which is supported turnably around its lower end. Inside of the both-face conveying unit 5, an intermediate conveying unit 6 is supported turnably around its lower end. On an upper face of an upper cover which covers an upper face of the apparatus main body 2*a*, an ejected sheet tray 7 on which a sheet is ejected is formed.

In a lower part of the apparatus main body 2, a sheet feeding cassette 9 which stores sheets S is attachably and detachably installed. On the right side of the sheet feeding cassette 9, a sheet feeding device 10 which feeds the sheet S from the sheet feeding cassette 9 is provided. Above the sheet feeding cassette 9, an exposure device 11 containing a laser scanning unit (LSU) is provided. Above the exposure device 11, an intermediate transferring unit 13 is supported so as to be slide through the opening 2*a* between a position to be stored in the apparatus main body 2 and another position to be pulled out the apparatus main body 2. The intermediate transferring unit 13 is provided with an endless intermediate transferring belt 14, four first transferring rollers 15 and a cleaning device 16. The intermediate transferring belt 14 is supported turnably around a driven roller 14*a* and a driving roller 14*b* which are disposed at a predetermined interval in the left and right direction. The first transferring rollers 15 are disposed aligning in the left and right directions in a lower space of a hollow space of the intermediate transferring belt 14. The cleaning device 16 is disposed outside of the left end of the intermediate transferring belt 14. The intermediate transferring unit 13 will be described later. Under each of the first transferring rollers 15, an image forming part 17 is provided.

In the image forming part 17, a photosensitive drum 18 is rotatably supported opposite to the first transferring roller 15. Between the photosensitive drum 18 and the intermediate transferring belt 14, a first transferring part 19 is formed. Around the photosensitive drum 18, a charger 20, a development device 21, a cleaning device 22 and a static eliminator 23 are disposed in sequential order along a rotation direction of the photosensitive drum 18. Above the intermediate transferring unit 13, toner containers 24 for every four color (Y, M, C and K) are installed corresponding to the image forming parts 17.

On the right side of the intermediate transferring unit 13, a second transferring roller 25 is rotatably supported to the intermediate conveying unit 6. Between the intermediate transferring belt 14 and the second transferring roller 25, a second transferring part 26 is formed. Above the second transferring part 26, a fixing device 28 is disposed. Above the fixing device 28, a sheet ejecting part 29 facing the ejected sheet tray 7 is provided.

In the apparatus main body 2, a main sheet conveying path 30 and a duplex printing path 31 are formed. The main sheet conveying path 30 extends from the sheet feeding device 10 to the sheet ejecting part 29 through the second transferring part 26 and the fixing device 28. The duplex printing path 31 is branched rightward from the main sheet conveying path 30 on a downstream side of the fixing device 28 and formed in an approximately C-shape. On the main sheet conveying path 30, a resist roller pair 33 is disposed on an upstream side from the second transferring part 26.

Next, the operation of forming an image by the color printer 1 having such a configuration will be described. In each image forming part 17, after a surface of the photosensitive drum 18 is charged by the charger 20, the exposure device 11 exposes the surface of the photosensitive drum 18 with a laser light based on an image date to form an electrostatic latent image on the surface of the photosensitive drum 18. The electrostatic latent image is then developed into a toner image of corresponding color toner by the developing device 21. The toner image formed on the photosensitive drum 18 is first transferred on a surface of the intermediate transferring belt 14 at the first transferring part 19 by the first transferring roller 15 which is charged with a transferring bias of the same polarity as the toner. The above operation is performed at each image forming part 17 to form a full color toner image on the intermediate transferring belt 14. The toner and charge remained on the photosensitive drum 18 are removed by the cleaning device 22 and the static eliminator 23, respectively.

On the other hand, the sheet fed from the sheet feeding cassette 9 by the sheet feeding device 10 is conveyed along the main sheet conveying path 30 into the second transferring part 26 in a suitable timing with the above image forming operation. At the second transferring part 26, the full color toner image on the intermediate transferring belt 14 is transferred on the sheet. The sheet on which the toner image is transferred is conveyed on a downstream side along the main sheet conveying path 30 and enters the fixing device 28 and then, the toner image is fixed on the sheet in the fixing device 28. The sheet with the fixed toner image is ejected from the sheet ejecting part 29 on the ejected sheet tray 7. When a duplex printing is performed, the sheet in which an image is formed on one face is conveyed through the duplex printing path 31 into the main sheet conveying path 30 to form an image on the other face of the sheet. The toner and paper dust remained on the intermediate transferring belt 14 are removed by the cleaning device 16.

Figure 2:
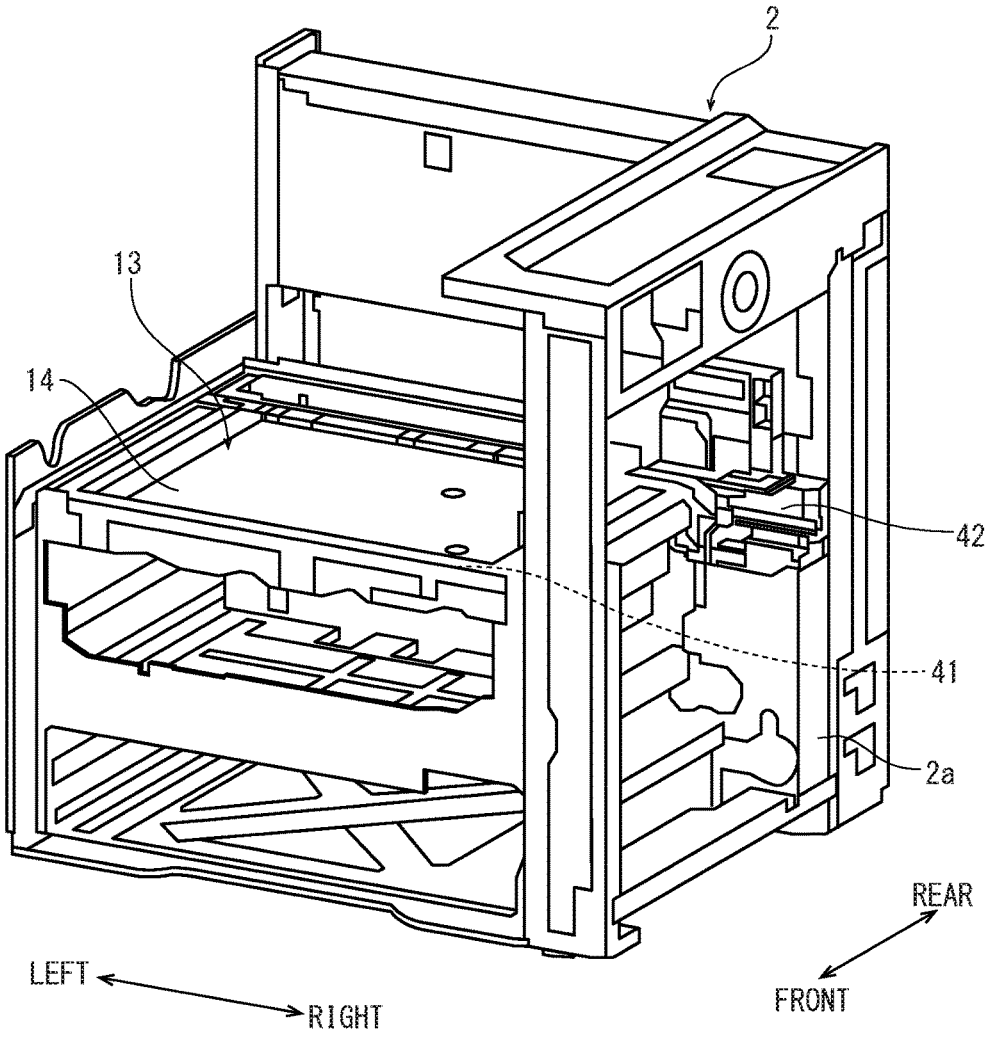
FIG. 2 is a perspective view showing an intermediate transferring unit supported on front and rear rails which are provided in an apparatus main body, in the color printer according to the embodiment of the present disclosure.
Figure 3:
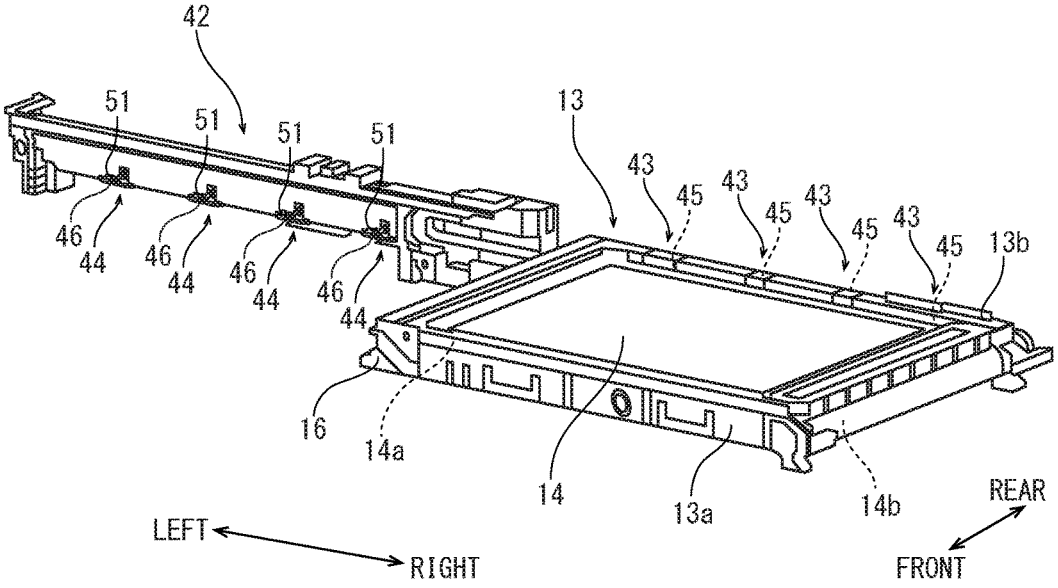
FIG. 3 is a perspective view showing the intermediate transferring unit and the rear rail, in the color printer according to the embodiment of the present disclosure.
Figure 4:
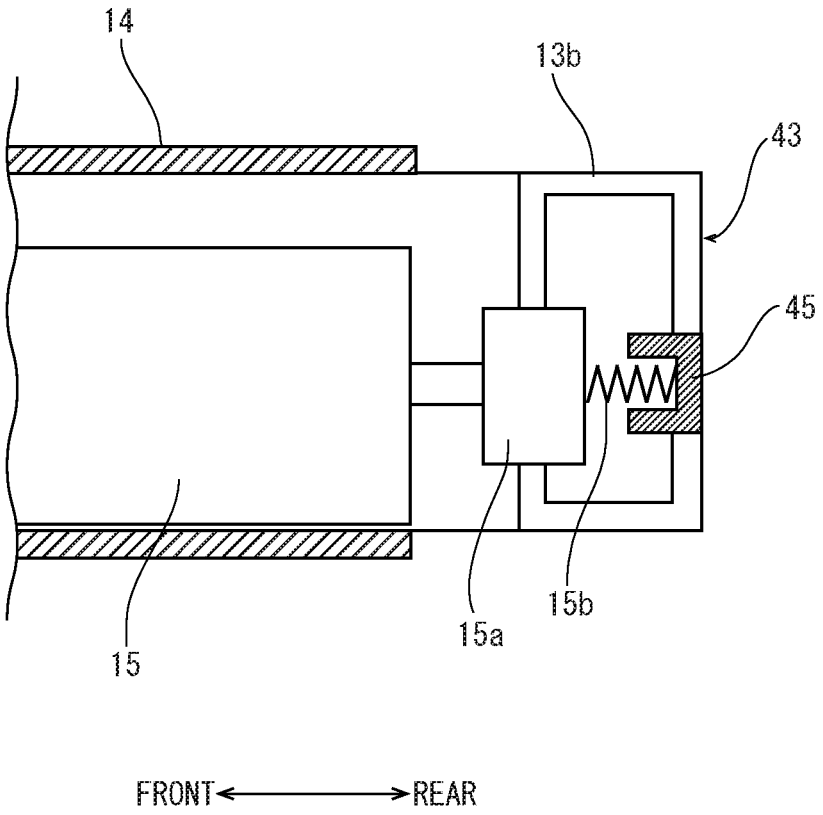
FIG. 4 is a sectional view showing a fixed contact point provided in the intermediate transferring unit, in the color printer according to the embodiment of the present disclosure.

Next, with reference to FIG. 1 and FIG. 2 to FIG. 4, the intermediate transferring unit 13 will be described. FIG. 2 is a perspective view showing the intermediate transferring unit housed in the apparatus main body; FIG. 3 is a perspective view showing the intermediate transferring unit and the front and rear rails; and FIG. 4 is a view schematically showing the fixed contact point.

As shown in FIG. 2, the apparatus main body 2 is provided with a pair of front and rear rails 41, 42 extending in the left and right directions. The front and rear rails 41, 42 are arranged opposing to each other in the front and rear directions near a center in a vertical direction of the apparatus main body 2. The intermediate transferring unit 13 is supported to be slidable along the pair of front and rear rails 41, 42. The intermediate transferring unit 13 is slid rightward to be pulled out through the opening 2*a* and is slid leftward to be housed in the apparatus main body 2.

The intermediate transferring unit 13, as shown in FIG. 3, has horizontally elongated front and rear supporting plates 13*a*, 13*b* which are arranged opposing to each other in the front and rear directions. Between the front and rear supporting plates 13*a*, 13*b*, the driving roller 14*b* is rotatably supported at the right end and the driven roller 14*a* is rotatably supported at the left end. The intermediate transferring belt 14 is wound around the driving roller 14*b* and the driven roller 14*a*. When the driving roller 14*b* is driven to rotate, the intermediate transferring belt 14 circulates and travels. In addition, the cleaning device 16 is supported by the front and rear supporting plates 13*a*, 13*b* on the left side of the driven roller 14*a*. Four first transferring rollers 15, as shown in FIG. 1, are disposed at the lower space of the hollow space of the intermediate transferring belt 14 and are rotatably supported between the front and rear supporting plates 13*a*, 13*b*.

The rear supporting plate 13*b* of the intermediate transferring unit 13 and the rear rail 42 of the pair of the front and rear rails 41, 42 are respectively provided with four unit side opposing parts 43 and four rail side opposing parts 44 which are arranged at intervals in the left and right directions. When the intermediate transferring unit 13 is housed in the apparatus main body 2, the four unit side opposing parts 43 and the four rail side opposing parts 44 oppose to each other in the front and rear directions. In addition, when the intermediate transferring unit 13 is housed in the apparatus main body 2, each unit side opposing part 43 and each rail side opposing part 44 are positioned corresponding to each first transferring roller 15.

The unit side opposing part 43 formed in the intermediate transferring unit 13 is formed with a fixed contact point 45. The rail side opposing part 44 formed in the rear rail 42 supports a movable contact point 46. When the intermediate transferring unit 13 is housed in the apparatus main body 2, the fixed contact point 45 and the movable contact point 46 are electrically connected to each other, and a transferring bias is applied from the transferring bias power source provided in the apparatus main body 2 to each first transferring roller 15.

The fixed contact point 45 will be described with reference to FIG. 4. The fixed contact point 45 is a U-shaped member in a side view, made of an electrically conductive material (for example, an SUS plate). The fixed contact point 45 is fixed to each unit side opposing part 43 of the rear supporting plate 13*b* of the intermediate transferring unit 13 with its rear face exposed rearward. A rear end portion of a rotating shaft of each first transferring roller 15 is rotatably supported on the rear supporting plate 13*b* with an electrically conductive bearing 15*a*. The electrically conductive bearing 15*a* and the fixed contact point 45 are electrically connected to each other by an electrically conductive spring member 15*b*. In this manner, the fixed contact point 45 and the first transferring roller 15 are electrically connected to each other through the spring member 15*b* and the electrically conductive bearing 15*a*.

Figure 5:
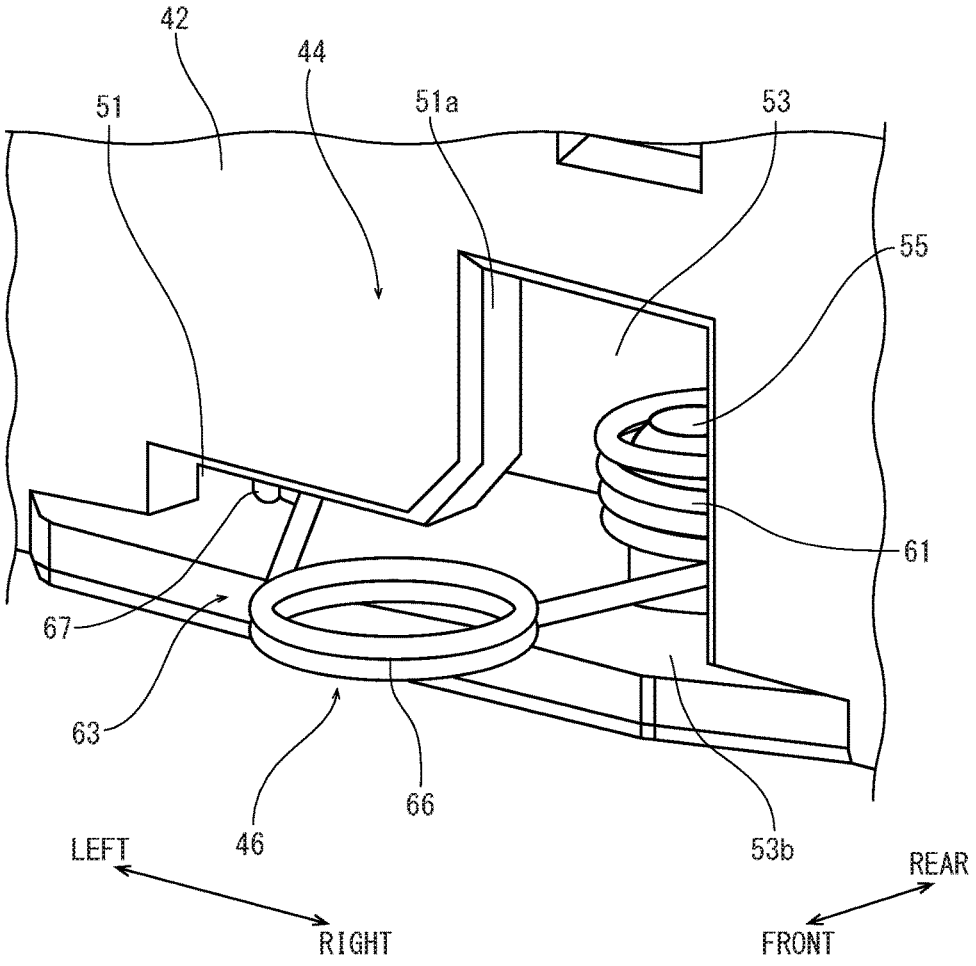
FIG. 5 is a perspective view showing a movable contact point supported on the rear rail, viewed from a front side, in the color printer according to the embodiment of the present disclosure.

Next, with reference to FIG. 3 and FIG. 5 to FIG. 6, the movable contact point 46 will be described. FIG. 5 is a perspective view showing the movable contact point supported in a housing recessed part formed in the rear rail, viewed from the front side; and FIG. 6 is a perspective view showing the movable contact point supported in the housing recessed part formed in the rear rail, viewed from the rear side.

Each rail side opposing part 44 of the rear rail 42, as shown in FIG. 3, is formed with an opening 51. As shown in FIG. 5, the opening 51 has a horizontally elongated shape along a length direction of the rear rail 42. In addition, the rear rail 42 is formed with a rectangular window 51*a* communicating with a right end portion of an upper edge of each opening 51.

Figure 6:
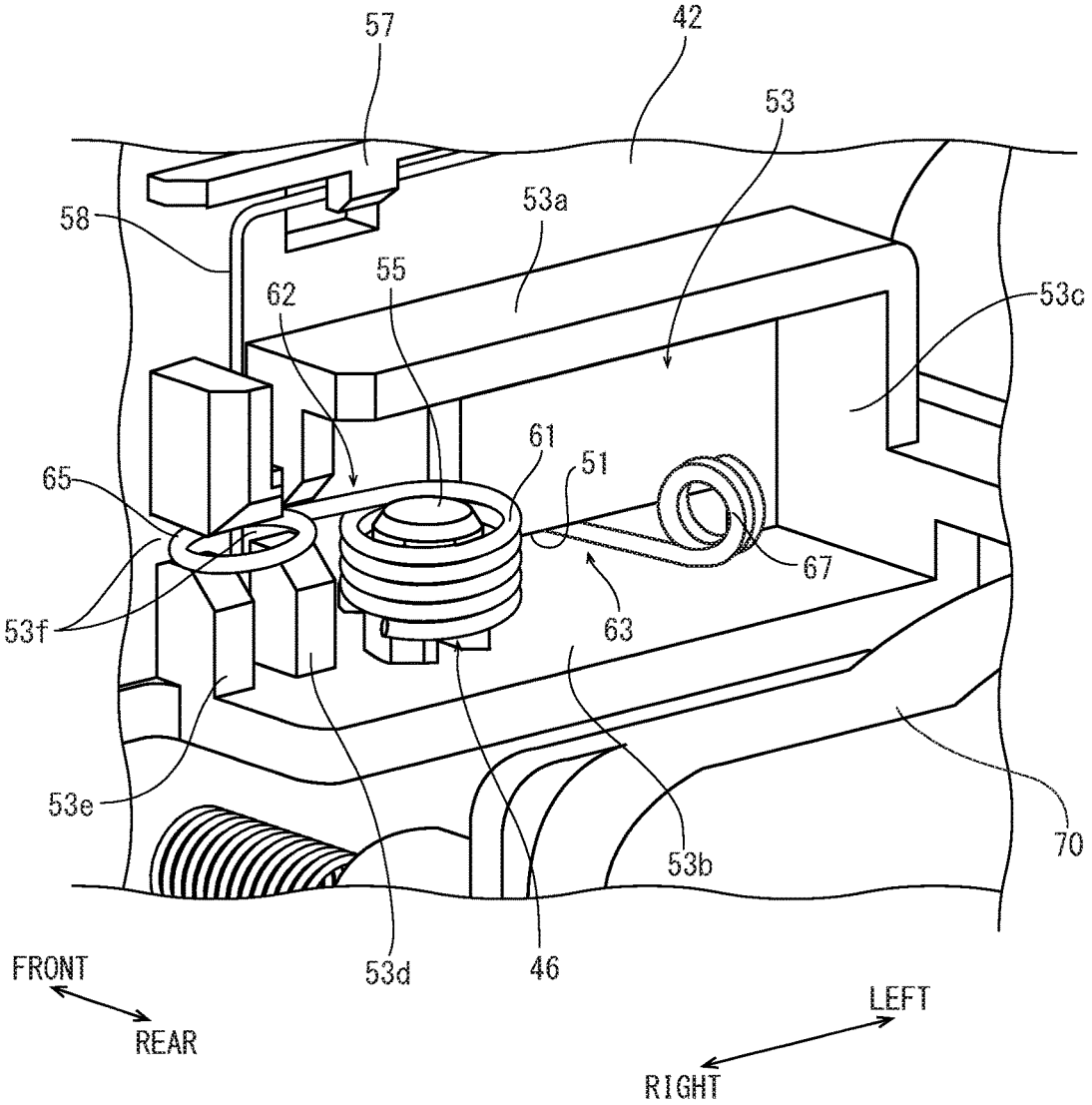
FIG. 6 is a perspective view showing the movable contact point supported on the rear rail, viewed from a rear side, in the color printer according to the embodiment of the present disclosure.

On a rear face of each rail side opposing part 44, as shown in FIG. 6, a housing recessed part 53 around the opening 51 is formed. The housing recessed part 53 is surrounded by top and bottom walls 53*a*, 53*b* and left and right walls 53*c*, 53*d*. A rear side face of the housing recessed part 53 is opened. As shown in FIG. 5, the bottom wall 53*b* is horizontally formed and protrudes slightly forward from the rear rail 42. Each corner of the protruded bottom wall 53*b* is formed in a tapered shape.

As shown in FIG. 6, on a right end portion of a top face of the bottom wall 53*b*, a boss 55 is erected. Further, on the bottom wall 53*b*, an outside wall 53*e* is formed at a predetermined interval outside of the right wall 53*d*. On each rear edge of the right wall 53*d* and the outside wall 53*e*, a triangular notch 53*f* in a side view is formed near a center in the vertical direction.

Further, on the rear face of each rail side opposing part 44, a hook 57 is formed above the housing recessed part 53. By the hook 57, a power line 58 to be connected to the transferring bias power source is supported. The power line 58 bends downward at each housing recessed part 53 and a tip end portion thereof is supported between the right wall 53*d* and the outside wall 53*e*.

Figure 7:
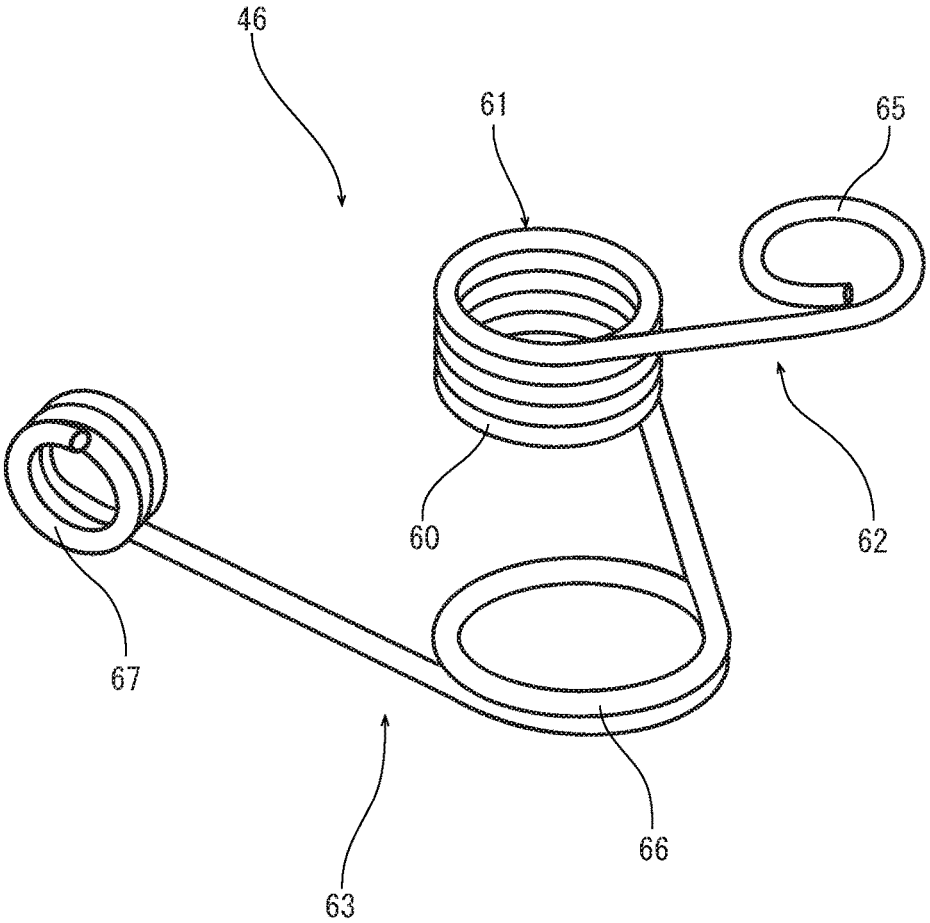
FIG. 7 is a perspective view showing the movable contact point, in the color printer according to the embodiment of the present disclosure.

Next, with reference to FIG. 7, the movable contact point 46 will be described. FIG. 7 is a perspective view showing the movable contact point.

The movable contact point 46 is a contact spring formed by winding an electrically conductive spring wire 60 into a coil spring shape. The movable contact point 46 has a winding part 61, a first extension part 62 and a second extension part 63. The winding part 61 is formed by spirally winding a middle portion of the wire 60 around the vertical axis. The first extension part 62 is formed of the wire 60 extending from an upper end of the winding part 61. The second extension part 63 is formed of the wire 60 extending from a lower end of the winding part 61.

At a tip end of the first extension part 62, an electrically conductive part 65 is formed by spirally winding one end portion of the wire 60 by one turn around the vertical axis.

At a middle portion of the second extension part 63, a contact part 66 is formed. At a tip end portion of the second extension part 63, a pull-out prevention part 67 is formed. The contact part 66 is formed by spirally winding the wire 60 by one and half turns around the vertical axis. In this manner, the second extension part 63 bends at an acute angle around the contact part 66. The pull-out prevention part 67 is formed by starting winding the other end portion of the wire 60 upward around the horizontal axis and then spirally winding it by two and half turns around the horizontal axis. The pull-out prevention part 67 is formed at a higher level than the contact part 66.

The movable contact point 46, as shown in FIG. 5 and FIG. 6, is supported in the housing recessed part 53 of the rear rail 42. The winding part 61 and the first extension part 62 of the movable contact point 46 form a fixing part to be fixed to the rear rail 42. The winding part 61 is fitted to the boss 55. The first extension part 62 is pinched between notches 53*f* formed in the right wall 53*d* and the outside wall 53*e*. In this manner, the movable contact point 46 is fixed to the rear rail 42 on an opposite side to the rail side opposing part 44. The electrically conductive part 65 is positioned in a gap between the right wall 53*d* and the outside wall 53*e* and is electrically connected to the power line 58 connecting to the transferring bias power source. The second extension part 63 is supported on the top face of the bottom wall 53*b* and is biased with respect to the first extension part 62 so that the contact part 66 protrudes forward from the bottom wall 53*b* through the opening 51 (refer to FIG. 5). In addition, the pull-out prevention part 67 is engagingly locked with an upper edge of the opening 51 so that the protruding position of the contact part 66 from the opening 51 is restricted (refer to FIG. 6).

Figure 8:
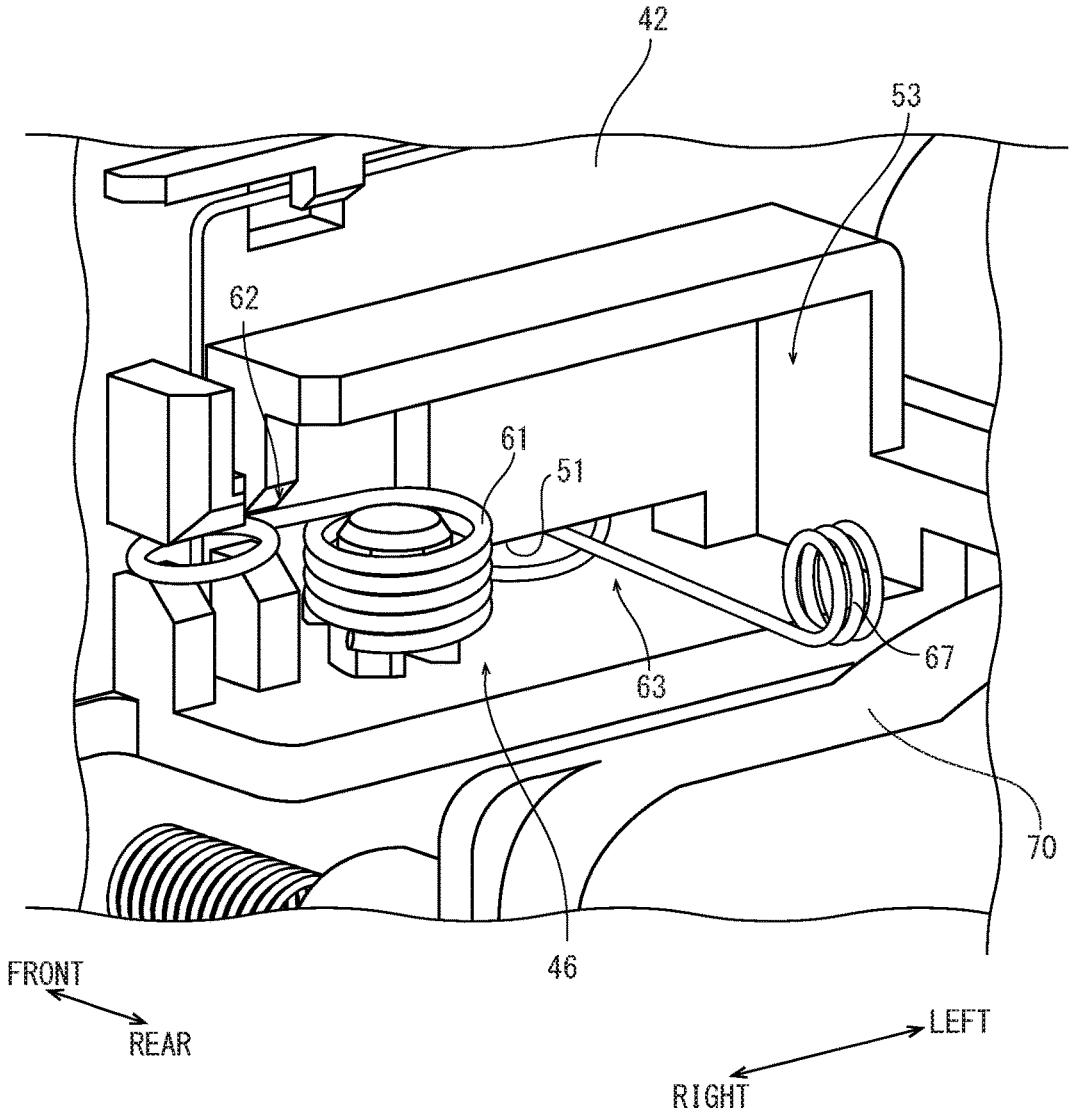
FIG. 8 is a perspective view showing the movable contact point coming into pressure contact with the fixed contact point, viewed from the rear side, in the color printer according to the embodiment of the present disclosure.

In the color printer 1 having the above construction, if the intermediate transferring unit 13 is slid along the pair of front and rear rails 41, 42 and then is housed in the apparatus main body 2, the contact part 66 of the movable contact point 46 supported on the rear rail 42 is pressed rearward by the rear face of the rear supporting plate 13*b* of the intermediate transferring unit 13. In this manner, the second extension part 63 turns on the top face of the bottom wall 53*b* in the clockwise direction of FIG. 5 and FIG. 6 with respect to the boss 55. If the intermediate transferring unit 13 is housed in the apparatus main body 2, each unit side opposing part 43 of the rear supporting plate 13*b* of the intermediate transferring unit 13 and each rail side opposing part 44 of the rear rail 42 oppose to each other. Then, the second extension part 63 of the movable contact point 46 is biased in the counterclockwise direction of FIG. 5 and FIG. 6 around the winding part 61 and then the contact part 66 is brought into pressure contact with the fixed contact point 45. Thus, the fixed contact point 45 and the movable contact point 46 are electrically connected to each other, and it becomes possible to apply a transferring bias from the transferring bias power source to each first transferring roller 15. In addition, if the contact part 66 is pressed rearward, as shown in FIG. 8, the pull-out prevention part 67 is spaced rearward from the bottom wall 53*b* of the housing recessed part 53.

On the other hand, if the intermediate transferring unit 13 is pulled out from the apparatus main body 2 along the pair of front and rear rails 41, 42, the pressing of the contact part 66 of the movable contact point 46 with respect to the fixed contact point 45 is released. In this manner, the second extension part 63 is biased in the counterclockwise direction of FIG. 5 and FIG. 6 around the winding part 61 and then the contact part 66 protrudes forward through the opening 51. However, because the pull-out prevention part 67 is engagingly locked with the upper edge of the opening 51, the protruding position of the contact part 66 is restricted. Here, because the pull-out prevention part 67 is formed at the higher level than the contact part 66, the pull-out prevention part 67 does not interfere with the bottom wall 53*b* of the housing recessed part 53 or parts 70 mounted under the rear rail 42 when it protrudes forward.

As has been described hereinabove, in the color printer 1 of the present disclosure, since the contact part 66 of the movable contact point 46 is engagingly locked with the upper edge of the opening 51 by the pull-out prevention part 67, the protruding position of the contact part 66 through the housing recessed part 53 can be restricted. Since the pull-out prevention part 67 is formed by spirally winding one end portion of the wire 60, it is hardly to be deformed. Therefore, in a case where the contact part 66 is hooked on the intermediate transferring unit 13 or the frictional force between the fixed contact point 45 and the contact part 66 is strong when the intermediate transferring unit 13 is pulled out, the pull-out prevention part 67 is engagingly locked with the upper edge of the opening 51 so that the protruding position of the contact part 66 through the housing recessed part 53 can be kept to be constant. As the result, the contact part 66 and the fixed contact point 45 can be reliably brought into contact with each other.

In a case where a force acting on the contact part 66 in the direction separating away from the housing recessed part 53 is strong, the pull-out prevention part 67 is deformed such that the winding of the pull-out prevention part 67 is released; and however, the remaining winding portion is engagingly locked with the upper edge of the opening 51. Therefore, even if such a deformation occurs, the contact part 66 is prevented from being pulled out through the opening 51.

Incidentally, in the case where the pull-out prevention part 67 is deformed such that the winding of the pull-out prevention part 67 is released, the protruding position of the contact part 66 slightly varies. However, when the intermediate transferring unit 13 is housed in the apparatus main body 2, since the second extension part 63 that is a movable portion is biased with respect to the first extension part 62 fixed to the rear rail 42, the positioning precision between the contact part 66 and the fixed contact point 45 does not significantly vary and the contact part 66 can be therefore reliably brought into contact with the fixed contact point 45. Also, it is possible to prevent the contact part 66 and the pull-out prevention part 67 from being completely pulled out through the opening 51.

In addition, the pull-out prevention part 67 is formed by starting winding the end portion of the wire 60 upward and then spirally winding the wire along the horizontal axis and is formed at the higher level than the contact part 66. Accordingly, when the second extension part 63 is turned, the pull-out prevention part 67 moves the inside of the housing recessed part 53 and does not interfere with the bottom wall 53*b* of the housing recessed part 53 or the parts 70 or the like mounted under the housing recessed part 53.

Further, since the contact part 66 is formed by spirally winding the wire 60 by one and half turns, an outer circumferential face of the wire 60 of the contact part 66 comes into point contact with the rear supporting plate 13*b* of the intermediate transferring unit 13. Therefore, the frictional force between the movable contact point 46 and the rear supporting plate 13*b* is reduced so that the intermediate transferring unit 13 can be smoothly slid. Furthermore, since the contact part 66 is formed by winding the wire 60 in two turns and two outer circumferential faces of the wire 60 come into contact with the fixed contact point 45, the contact part 66 can be constantly brought into contact with the fixed contact point 45.

Although the present embodiment is described as to the case in which the pull-out prevention part 67 is formed by winding spirally along the horizontal axis, the pull-out prevention part 67 may be formed by winding along the vertical axis depending on the shape of the contact part 66 or the dimensions and position of the opening 51. Also, although in the present embodiment, the pull-out prevention part 67 is formed at the higher level than the contact part 66, the pull-out prevention part 67 may be formed at a lower level than the contact part 66 or formed so as to protrude upward or downward from the contact part 66 depending on the shape of the contact part 66 or the dimensions or position of the opening 51.

In addition, although the present embodiment is described as to the intermediate transferring unit 13 as a unit supported to be slidable between a position to be housed in the apparatus main body 2 and a position to be pulled out from the apparatus main body 2, the present disclosure can be applied to a unit requiring electrical connection to the apparatus main body 2 and attached to or detached from the apparatus main body 2 by way of sliding movement.

While the preferable embodiment and its modified example of the sheet feeding device and the image forming apparatus of the present disclosure have been described above and various technically preferable configurations have been illustrated, a technical range of the disclosure is not to be restricted by the description and illustration of the embodiment. Further, the components in the embodiment of the disclosure may be suitably replaced with other components, or variously combined with the other components. The claims are not restricted by the description of the embodiment of the disclosure as mentioned above.

What is claimed is:

1. An image forming apparatus comprising:

a unit supported to be slidable along a rail between a position to be housed in an apparatus main body and a position to be pulled out from the apparatus main body;

a unit side opposing part and a rail side opposing part respectively provided on the unit and the rail so as to oppose to each other when the unit is slid along the rail into the position to be housed in the apparatus main body;

a fixed contact point provided in the unit side opposing part of the unit; and a movable contact point provided in the rail side opposing part of the rail and brought into pressure contact with the fixed contact point so as to be electrically connected to the fixed contact point, wherein the rail side opposing part of the rail is formed with an opening, the movable contact point is a contact spring formed of an electrical conductive wire, and has:

a fixing part to be fixed to the rail on an opposite side to the rail side opposing part;

a contact part biased with respect to the fixing part to protrude toward the fixed contact point through the opening; and a pull-out prevention part configured to restrict a protruding position of the contact part toward the fixed contact point, and wherein the pull-out prevention part is formed into a spiral shape.

2. The image forming apparatus according to claim 1, wherein the movable contact point has:

a winding part formed by spirally winding a middle portion of the wire along a vertical axis;

a first extension part formed of the wire extending from an upper end of the winding part; and a second extension part formed of the wire extending from a lower end of the winding part, wherein the fixing part is formed by the winding part and the first extension part, the contact part is formed at a middle portion of the second extension part and the pull-out prevention part is formed at a tip end portion of the second extension part, wherein the pull-out prevention part is formed by spirally winding the tip end portion of the second extension part along a horizontal axis.

3. The image forming apparatus according to claim 2, wherein the pull-out prevention part is formed at a higher level than the contact part.

4. The image forming apparatus according to claim 2, wherein the contact part is formed by spirally winding the wire along the vertical axis by at least one turn or more.

5. The image forming apparatus according to claim 2, wherein the contact part is positioned to be deeper from the fixing part in an attaching direction in which the unit is to be housed in the apparatus main body, and the pull-out prevention part is positioned to be deeper from the contact part in the attaching direction of the unit.

6. The image forming apparatus according to claim 2, wherein the pull-out prevention part is engagingly locked with an upper edge of the opening.

7. The image forming apparatus according to claim 1, wherein the rail has a horizontal supporting portion configured to support the contact part and the pull-out prevention part.

8. The image forming apparatus according to claim 1, wherein the unit is an intermediate transferring unit having an endless intermediate transferring belt which is rotatably provided and a transferring roller which is disposed in a hollow space of the intermediate transferring belt, the fixed contact point is electrically connected to the transferring roller, the movable contact point is electrically connected to a transferring bias power source, and by electrically connecting the fixed contact point and the movable contact point to each other, a transferring bias is applied from the transferring bias power source to the transferring roller, enabling a toner image to be transferred onto the intermediate transferring belt.

* * * * *